US007051398B2

(12) United States Patent
Smith et al.

(10) Patent No.: US 7,051,398 B2
(45) Date of Patent: May 30, 2006

(54) VACUUM CANISTER WITH AUXILIARY INTAKE VALVE

(75) Inventors: James F. Smith, Louisville, OH (US); Darrell V. Nieschwitz, Alliance, OH (US); Andrew L. Gabric, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 452 days.

(21) Appl. No.: 10/385,819

(22) Filed: Mar. 10, 2003

(65) Prior Publication Data

US 2004/0177468 A1 Sep. 16, 2004

(51) Int. Cl.
*A47L 5/28* (2006.01)
*A47L 9/10* (2006.01)

(52) U.S. Cl. ..... 15/314; 15/353

(58) Field of Classification Search ..... 15/314, 15/353, 327.6, 331, 319
See application file for complete search history.

(56) References Cited

U.S. PATENT DOCUMENTS 3,283,093 A * 11/1966 Bishop ..... 15/301
3,543,325 A * 12/1970 Hamrick ..... 15/314
4,654,926 A * 4/1987 McCambridge ..... 15/327.6
4,735,579 A * 4/1988 Muser ..... 439/191

* cited by examiner

*Primary Examiner*—Richard Crispino
*Assistant Examiner*—Laura C Guidotti
(74) *Attorney, Agent, or Firm*—Sand & Sebolt

(57) ABSTRACT

A vacuum canister for use with a central vacuum system is disclosed. The vacuum canister includes a hollow, tubular housing that has openings at either end. A cover covers the upper opening and a dust collection bin is disposed beneath the lower opening. The housing is divided into clean and dirt collection chambers by a wall. The clean chamber is a dust-free area and the vacuum pump assembly is mounted therein. The dirt collection chamber is the area in the canister where the dirt-laden vacuumed air is drawn into the device. The vacuum canister is provided with an auxiliary vacuum intake assembly that enters the housing in the clean, dust-free chamber. The intake assembly includes a receptacle for receiving the end fitting of a portable vacuum hose and the receptacle is operatively connected to the dirt collection chamber of the housing by way of a conduit that extends from the receptacle through an aperture in the wall and into the dirt collection chamber. The receptacle is wired to the motor for the vacuum pump assembly so that when the portable hose is attached to the receptacle, the vacuum pump is automatically started. The wiring for the receptacle passes through the clean chamber of the housing. The receptacle includes a pivoted cover which covers the receptacle when it is not in use so as to maintain the vacuum within the system.

21 Claims, 9 Drawing Sheets

| |
|---|
| FIG-3A |
| FIG-3B |

VACUUM CANISTER WITH AUXILIARY INTAKE VALVE

BACKGROUND OF THE INVENTION

1. Technical Field

This invention generally relates to a vacuum canister for a central vacuum system. More particularly, the invention relates to a vacuum canister that includes an auxiliary vacuum intake assembly that is mounted in the clean air chamber of the vacuum canister. Specifically, the invention relates to a vacuum canister that has an automatic electronic auxiliary vacuum intake assembly mounted in the clean air chamber of the vacuum canister.

2. Background Information

Central vacuum cleaner systems are common in newer homes and other buildings. These systems provide a convenient and easy way for periodically vacuuming the floors or rugs in the various rooms of a building and they eliminate the need for moving cumbersome hand-held units from room-to room.

Central vacuum systems typically include a vacuum canister, a light, portable hose, a range of vacuum cleaner attachments, a network of conduits installed in the walls and floors of the building and a number of wall-mounted receptacles. The vacuum canister is usually positioned in an out-of-the-way location in the building, such as the basement, utility room or garage.

Vacuum canisters include an electric vacuum pump assembly that is used to create the suction to draw dust-laden air through the portable vacuum hose and the rest of the central vacuum system. Canisters also include a motor for driving the pump, a filter for collecting dust entrained in the airstream, a device for collecting the entrained dust and a mechanism for circulating cleaned air back into the building.

The portable hose used with these types of systems is typically a flexible hose that includes an elongated rigid tube at one end and an end fitting at the other end. Various cleaning attachments are connectable to the elongated rigid tube and the end fitting is connectable to the conduit system through the wall receptacles.

The wall receptacles include an intake valve covered by an airtight flap or pivotable valve plate to prevent air from being unintentionally drawn into the conduit system. This maintains the vacuum state within the central vacuum system. Air enters the system only through the wall receptacle to which the portable hose is attached. The vacuum pump assembly motor is automatically turned when the portable hose is attached to the wall receptacle. This is accomplished through the provision of an electrical connection between the wall receptacle and the motor in the vacuum canister. A shorted two-prong connector is mounted to the end fitting of the portable vacuum hose that connects to the receptacle. A mating connector is built into the receptacle. The electric motor is automatically turned on when the connectors are mated during insertion of the end fitting into the receptacle. The motor is automatically turned off when the end fitting is removed from the receptacle.

It is reasonably expensive to provide the conduits and automatically activated wall receptacles for central vacuum systems. It has therefore been fairly common practice to not provide an automatically activated wall receptacle for the room in which the vacuum canister is located. As an alternative, vacuum canister manufacturers have provided an auxiliary vacuum intake assembly located on the canister itself. The auxiliary vacuum intake assembly is positioned on the canister so that it feeds directly into the area of the canister that filters the vacuumed air. The user simply attaches the portable hose to the auxiliary vacuum intake assembly. These auxiliary vacuum intake assemblies may not include automatic starting of the vacuum pump when the hose is inserted into the vacuum opening of the receptacle. The user therefor has to manually activate the main on/off switch for the vacuum canister in order to start the motor and vacuum pump. Some central vacuum canisters, however, are provided with automatic starting and stopping of the vacuum pump. In these instances, the auxiliary vacuum intake assembly and the motor have to be wired together. It has been common practice to feed the wires from the auxiliary vacuum intake assembly, through the dust catchment area to the motor. The problem with this is that the dust and debris traveling through the dust catchment area tend to damage the wiring. In order to overcome this problem, some have installed the wiring from the assembly to the motor by positioning the wires on the outside surface of the vacuum canister. External wiring is, however, both unsightly and potentially dangerous and the wiring may easily become dislodged.

There is therefore a need in the art for providing a mechanism for providing a convenient, cost effective, vacuum canister with an electronic auxiliary vacuum intake assembly therein.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DETAILED DESCRIPTION OF THE INVENTION

Figure 1:
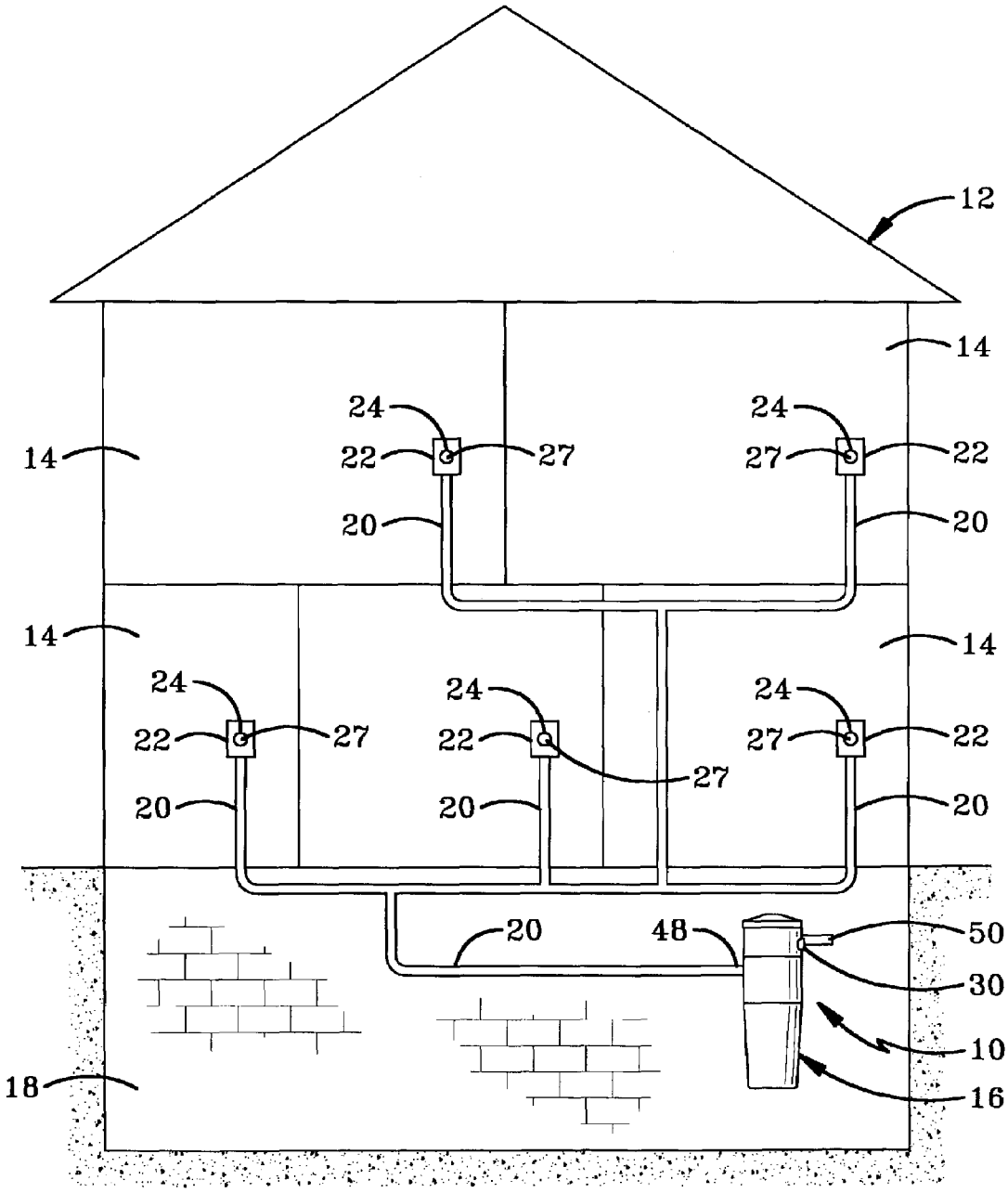
FIG. 1 is a diagrammatic view in of a house having a central vacuum system which utilizes the vacuum canister of the present invention.
Figures 2, 3:
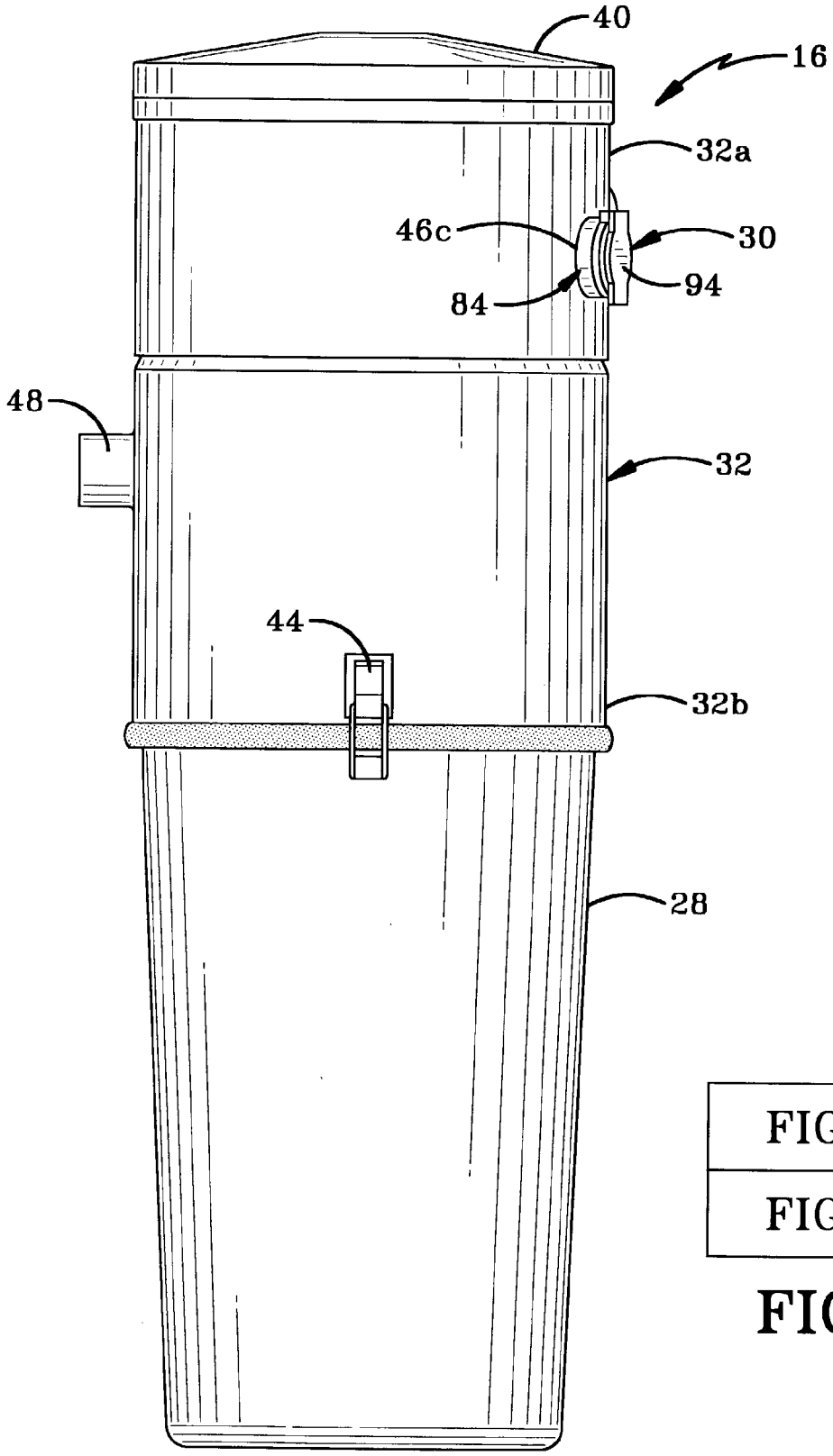
FIG. 2 is a side elevational view of the vacuum canister of FIG. 1.
Figure 9:
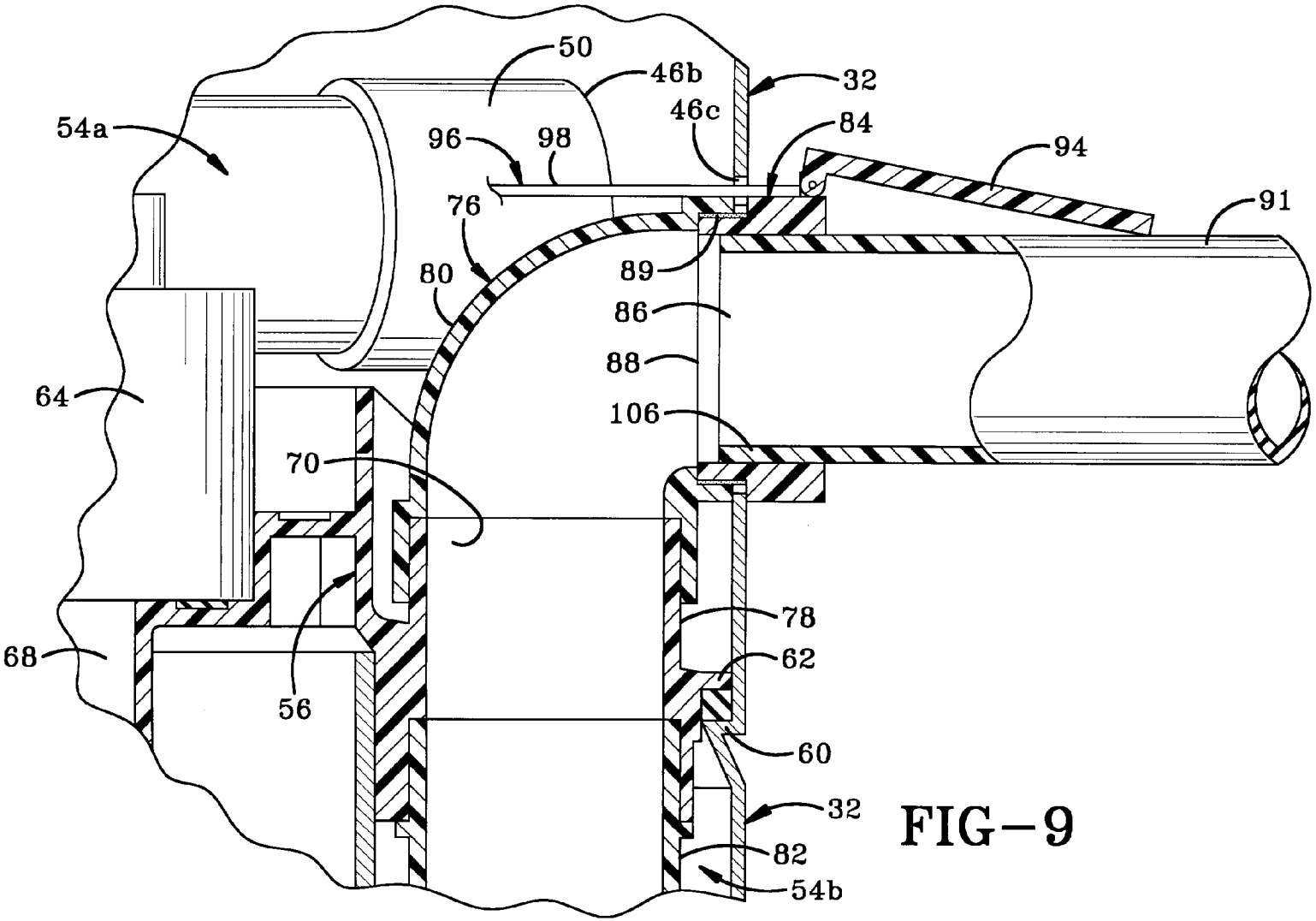
FIG. 9 is a fragmentary longitudinal vertical sectional view of the auxiliary vacuum intake assembly corresponding to FIG. 7, but with an intake tube of a portable hose inserted therein.
Figure 10:
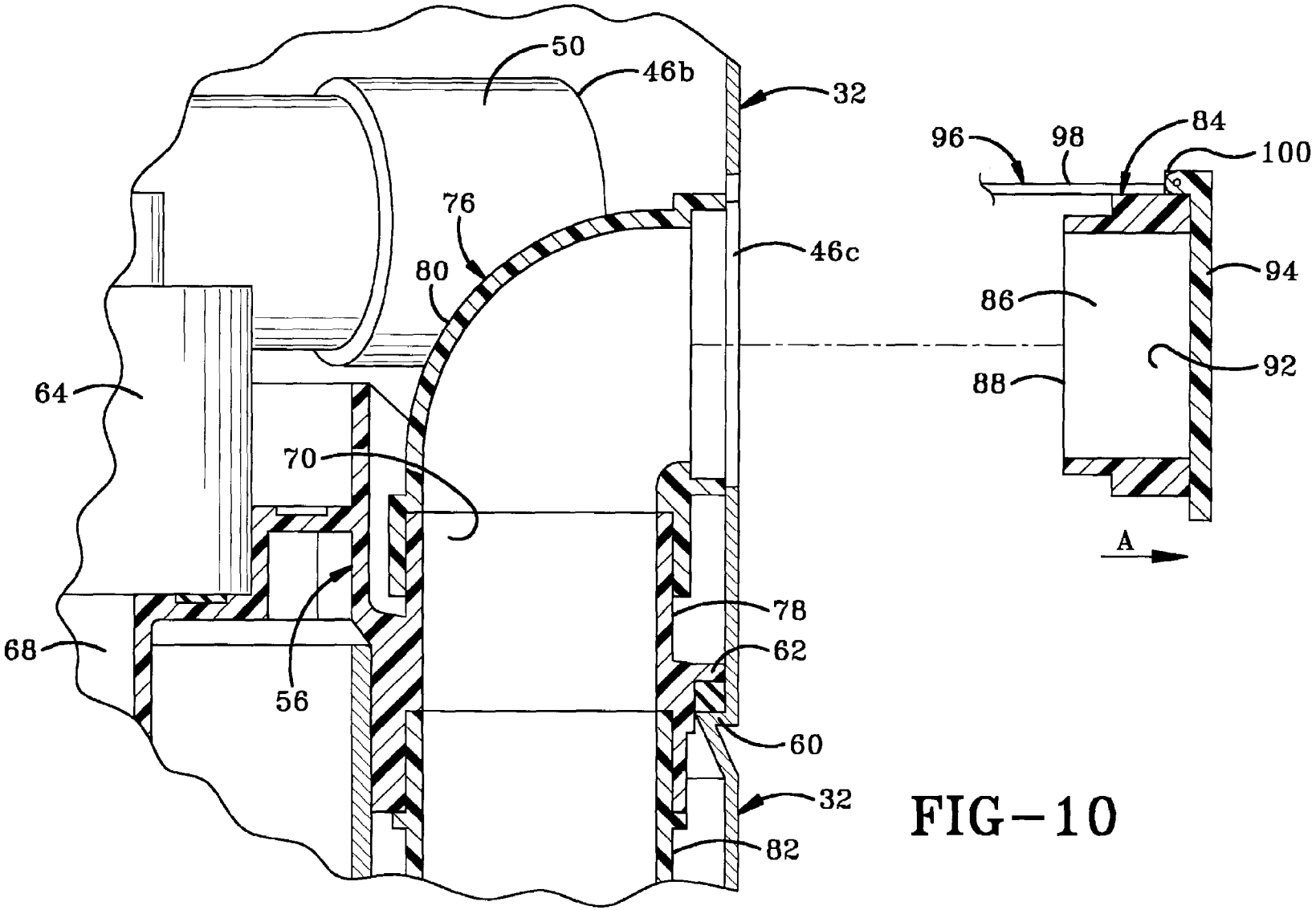
FIG. 10 is an exploded fragmentary longitudinal vertical sectional view of the auxiliary vacuum intake assembly of the canister corresponding to FIG. 7.

Referring to FIG. 1 there is shown a central vacuum system, generally referenced by the number 10, installed in a house 12 that has a plurality of rooms 14. System 10 includes a vacuum canister 16 which is preferably located in a less-used area of house 12, such as the basement 18. A series of conduits 20 connect vacuum canister 16 to a plurality of intake valves or receptacles 22, each of which is preferably located in a separate room 14 in house 12. Each receptacle 22 includes a vacuum opening 24 that is adapted to receive an end fitting (not shown) of a flexible hose 91 (FIG. 9). Each receptacle 22 is covered by a flap or pivotal plate 27 to prevent air from flowing into receptacle 22 when the flexible hose is not connected thereto. Basement 18 does not have a receptacle 22 and this room is serviced by the provision of an auxiliary vacuum intake assembly 30 on vacuum canister 16 itself.

Figure 3A:
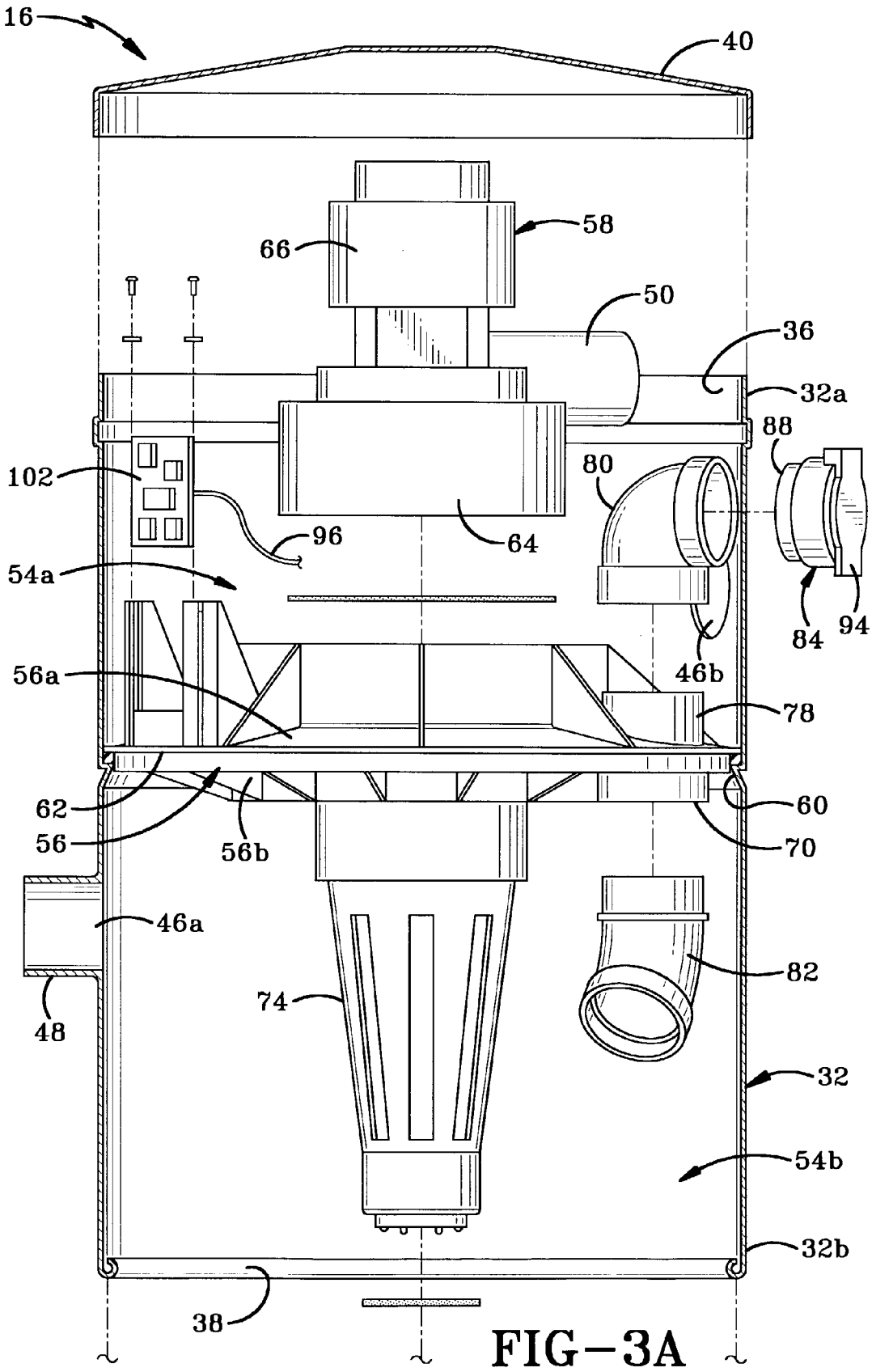
FIG. 3A is a partially exploded cross-sectional side view of the upper portion of the vacuum canister of FIG. 1.
Figure 3B:
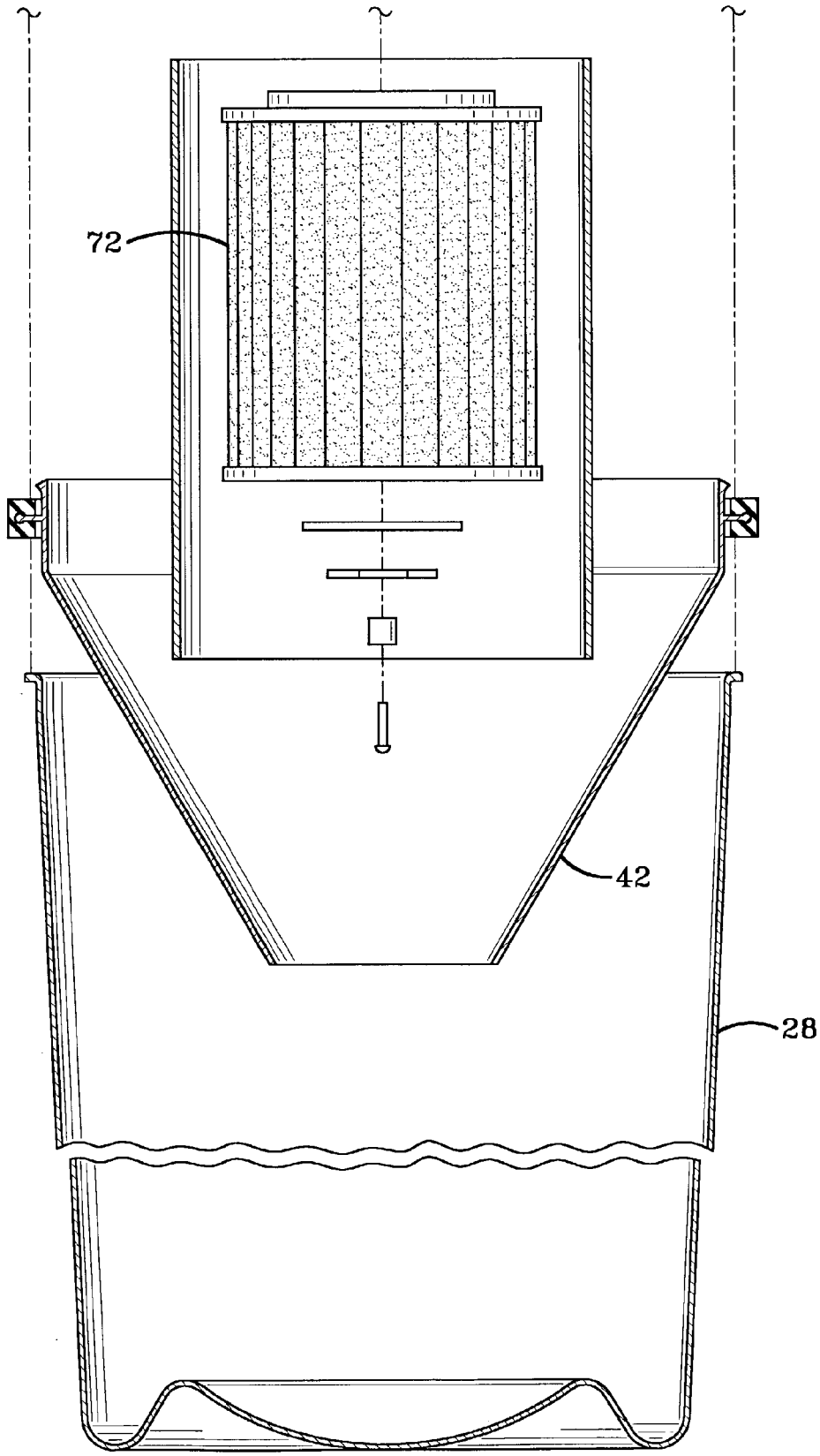
FIG. 3B is a partially exploded cross-sectional side view of the lower portion of the vacuum canister of FIG. 1.
Figure 4:
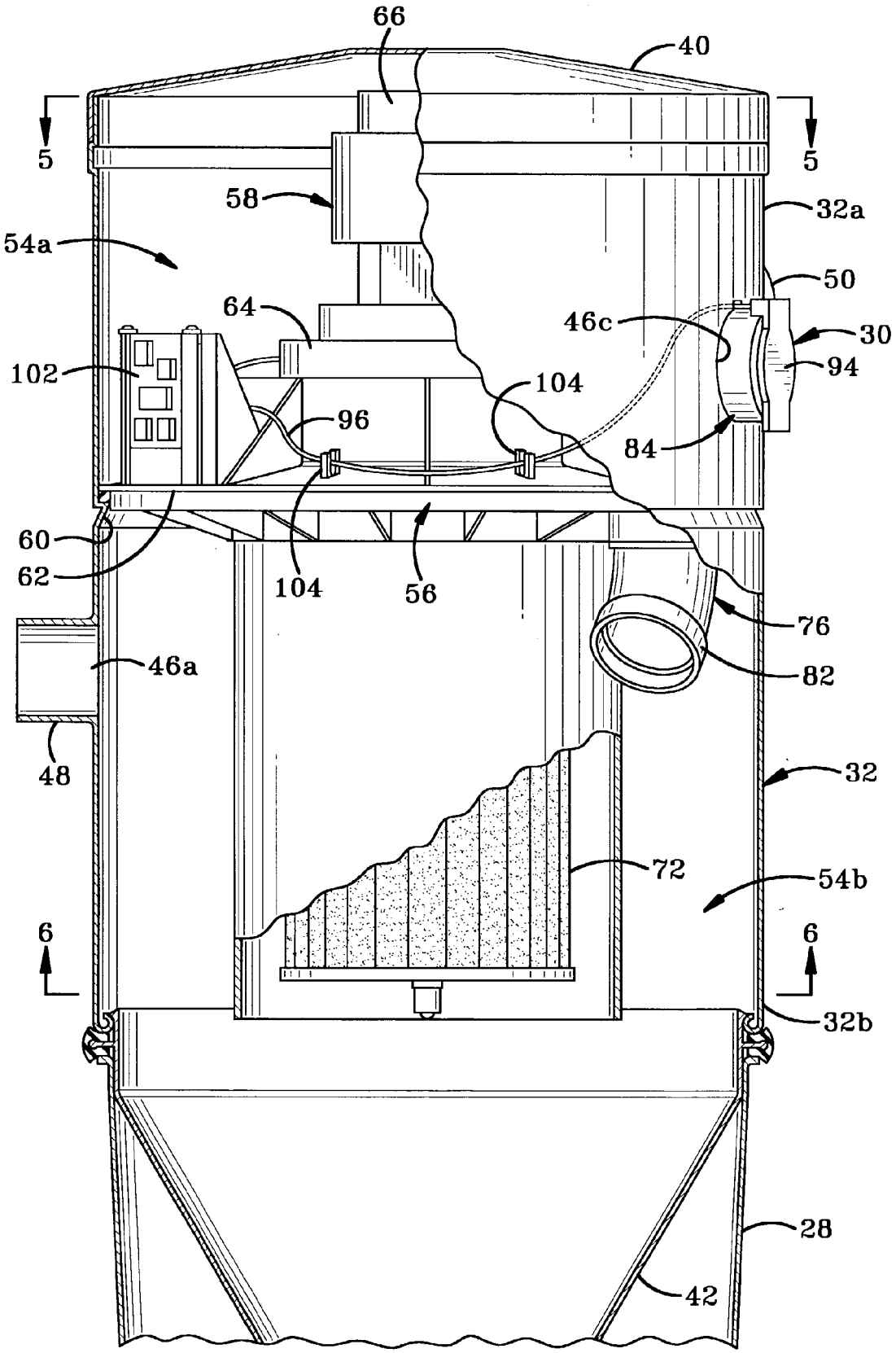
FIG. 4 is a fragmentary cross-sectional side view of the vacuum canister of the vacuum canister of FIG. 1.
Figure 5:
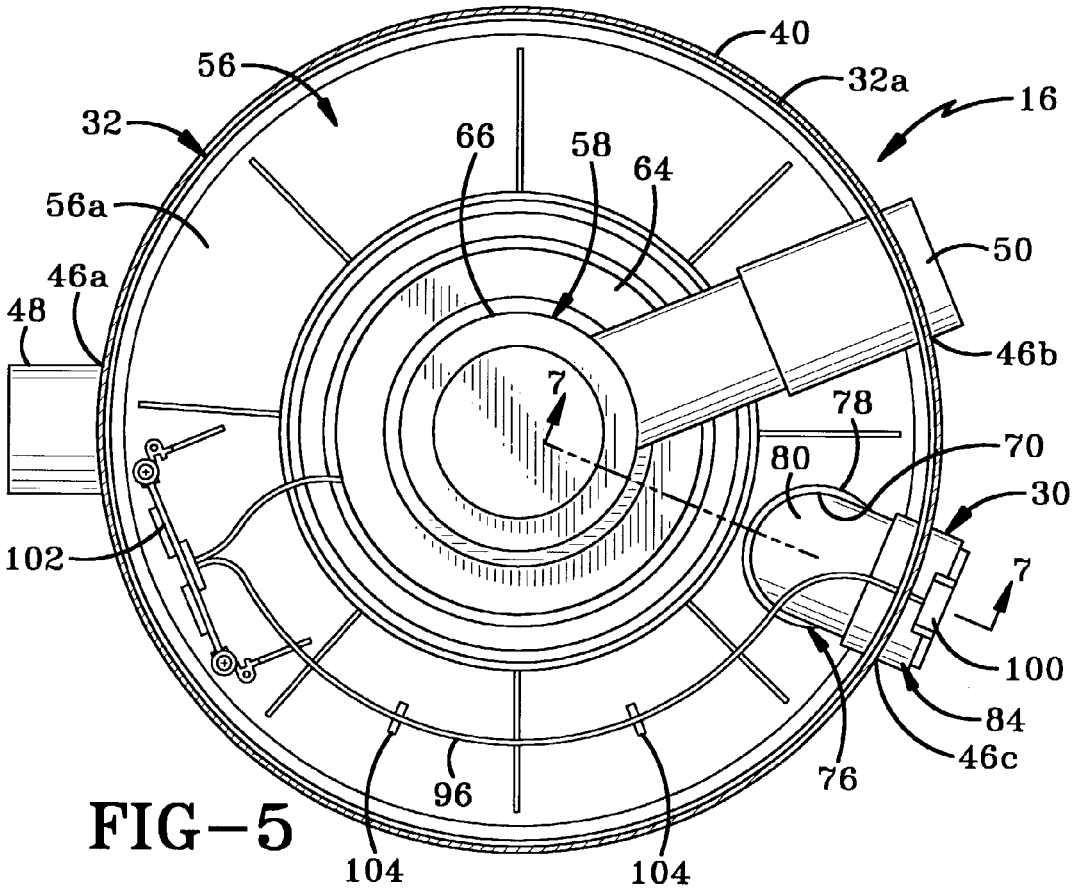
FIG. 5 is a lateral horizontal sectional view of the vacuum canister taken along the line 5—5, FIG. 4.
Figure 6:
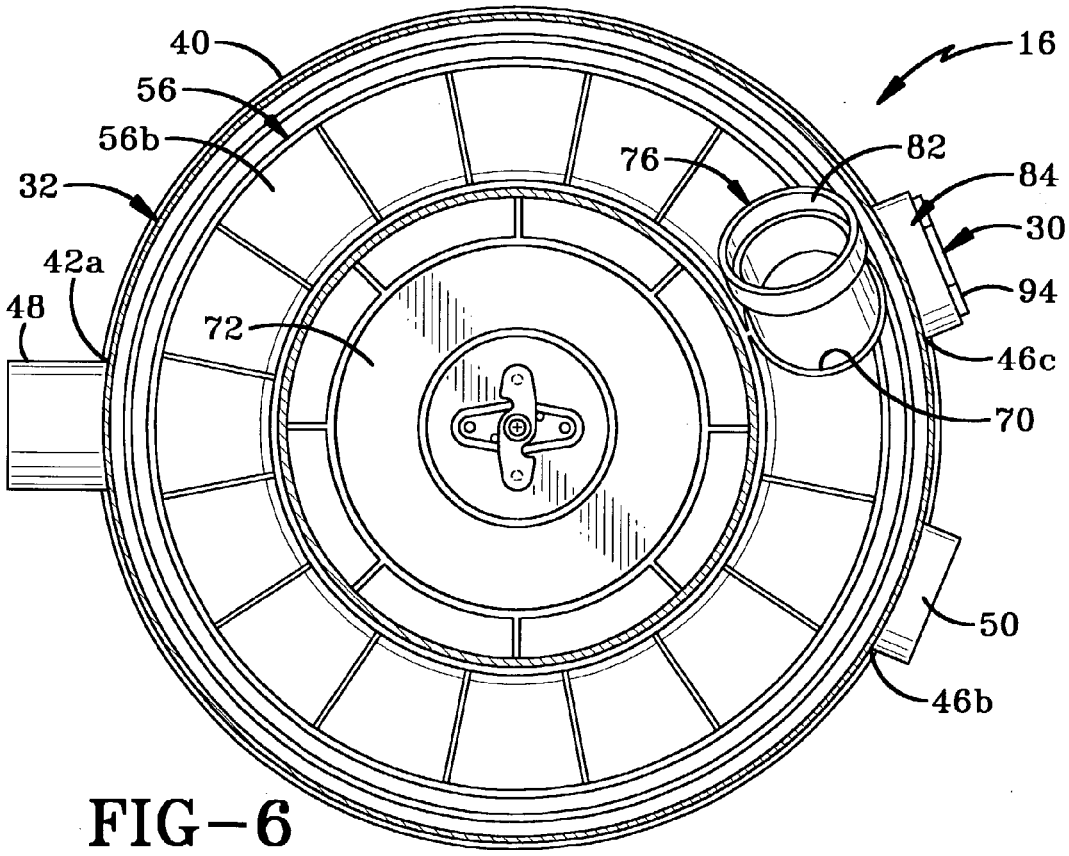
FIG. 6 is a lateral horizontal sectional view of the vacuum canister taken along the line 6—6, FIG. 4.
Figure 8:
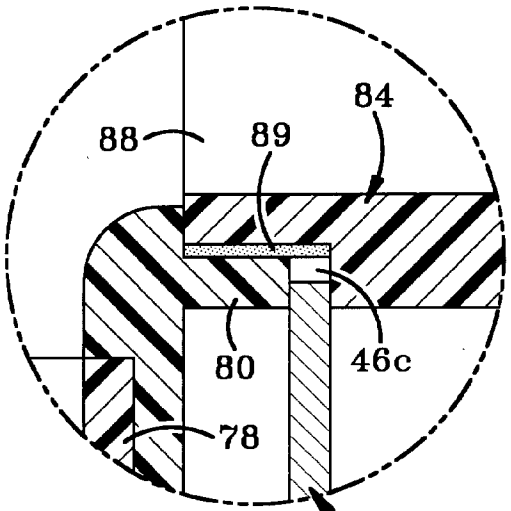
FIG. 8 is an enlarged view taken on the line 8—8, FIG. 7.
Figure 7:
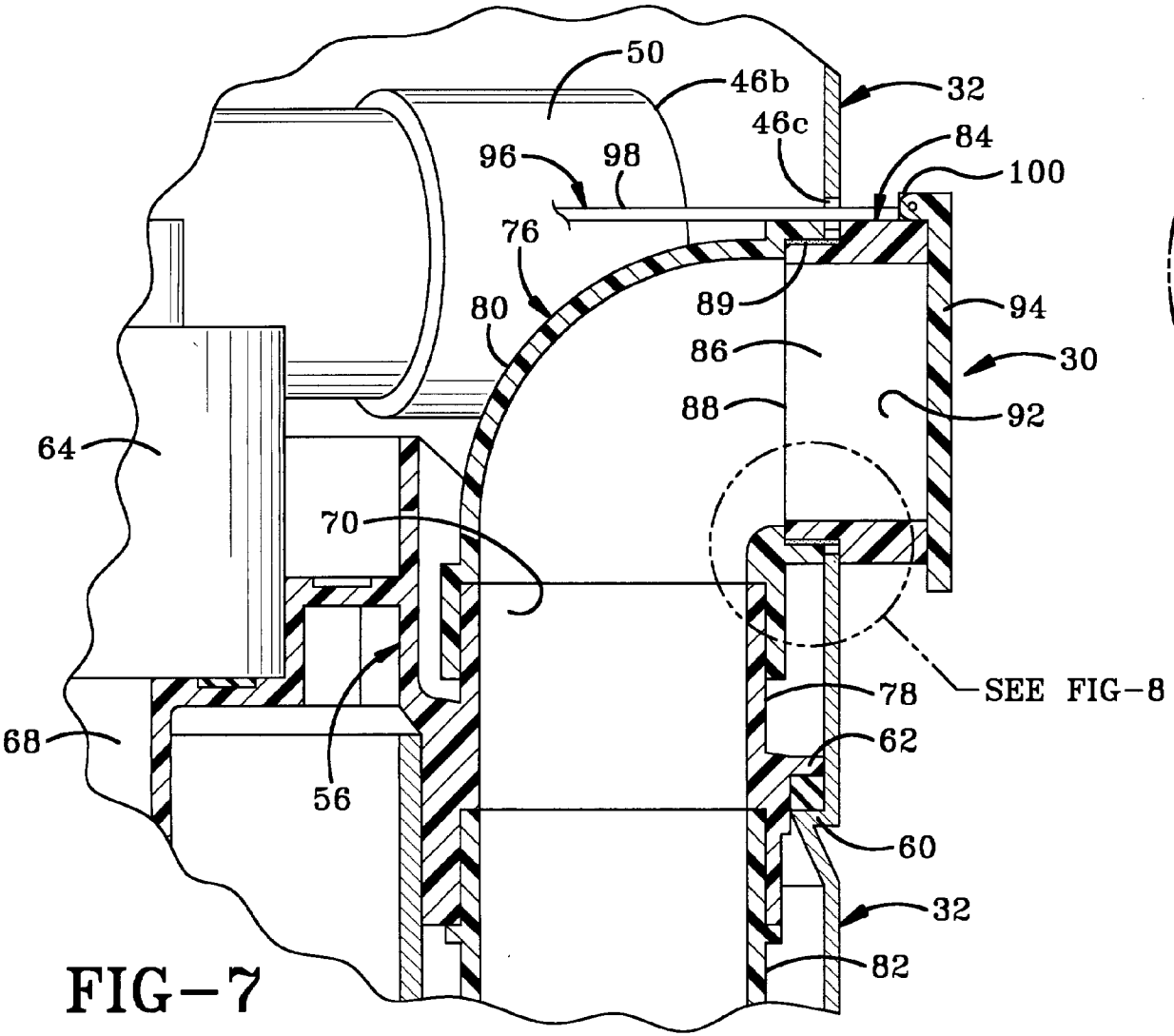
FIG. 7 is a fragmentary longitudinal vertical section view of an auxiliary vacuum intake assembly taken along the line 7—7, FIG. 5.

Referring to FIGS. 2–6 there is shown a vacuum canister 16 in accordance with the present invention. Vacuum canister 16 includes a substantially hollow housing, generally referred to by the number 32. Housing 32 is generally cylindrical in shape and has an upper end 32*a* and a lower end 34*b*. Upper end 32*a* defines a first opening 36 and lower end 32*b* defines a second opening 38. First opening 36 is covered by a removable cover 40. A hopper 42 is disposed beneath second opening 38 and hopper 42 funnels the collected dust into a dust collection bin 28 disposed beneath hopper 42. Collection bin 28 is preferably releasably secured to the lower end 32*b* of housing 32 by way of a latch 44 or other suitable means. Housing 32 defines three holes 46*a*, 46*b*, 46*c* (FIGS. 3A, 5 & 6) for receiving various pipes into vacuum canister 16. First hole 46*a* receives a suction intake pipe 48 that is connected to conduits 20. Second hole 46*b* receives an exhaust pipe 50 for exhausting air back into house 12. Third hole 46*c* receives an auxiliary vacuum intake assembly 30 for connecting a portable vacuum hose 91 thereto. Housing 32 is internally divided into an upper or clean chamber 54*a* and a lower or dirt collection chamber 54*b* by a mounting plate or bracket 56. First hole 46*a* is positioned so that suction intake pipe 48 enters dirt collection chamber 54*b*, while second hole 46*b* and third hole 46*c* are positioned so that exhaust pipe 50 and auxiliary vacuum intake assembly 30 enter/exit clean chamber 54*a*.

In accordance with the present invention, a wall 56 is provided that separates housing 32 into clean and dirt collection chambers 54*a*, 54*b*, and that supports a vacuum pump assembly 58, filter support 74 and a filter 72. Wall 56 is preferably a single, integral structure that is molded from plastic or some other suitable material. Wall 56 may, however, be made as more than one component without departing from the scope of this invention. Wall 56 has an upper surface 56*a* and a lower surface 56*b*, it is preferably circular in shape and defines both a central bore 68 and an aperture 70. Both bore 68 and aperture 70 connect clean chamber 54*a* to dirt collection chamber 54*b*. Wall 56 is of a slightly smaller diameter than the internal diameter of housing 32. An inwardly disposed, annular ledge 60 is provided in housing 32 for supporting wall 56. An annular lip 62 is formed on lower surface 56*b* of wall 56, and annular lip 62 is adapted to rest on annular ledge 60 when wall 56 is positioned inside housing 32. Upper surface 56*a* of wall 56 is adapted to support a vacuum pump assembly 58 that includes an AC (alternating current) motor 64 for driving a vacuum pump 66. Clean chamber 54*a* is a dust-free zone while dirt collection chamber 54*b* is a dust-laden zone. Vacuum pump 66 and motor 64 are mounted on wall 56 in such a manner that they lie entirely or mainly in the dust-free zone of clean chamber 54*a*. This aids in preventing the dust in the vacuum system 10 from damaging vacuum pump assembly 58. A filter 72 is attached to a filter support 74 that extends from wall 56 and into dirt collection chamber 54*b*. Dust-laden air from house 12 is suctioned into dirt collection chamber 54*b* through suction intake pipe 48, swirls around filter 72, is sucked through filter 72 and into the air stream that travels upwardly through bore 68 and into clean chamber 54*a*. Cleaned air from clean chamber 54*a* is exhausted into house 12 through exhaust pipe 50.

As is more clearly shown in FIGS. 7–10, the device of the present invention provides an auxiliary vacuum intake assembly 30 that enters clean chamber 54*a*. The auxiliary vacuum intake assembly 30 is consequently in the dust-free zone of vacuum canister 16. Auxiliary vacuum intake assembly 30 includes a rigid tube assembly 76 having a short straight tube 78 which is secured within hole 46*b* of wall 56 with a ninety-degree elbow 80 and a forty-five-degree elbow 82 which are removably fixed thereto using a minimal amount of an adhesive, so as to be replaceable if needed. The adhesive is applied in such a manner as to be breakable upon application of sufficient force. Straight tube 78 may be integrally molded or formed as part of wall 56. Forty-five degree elbow 82 extends generally tangentially downward into dirt collection chamber 54*b*. A receptacle 84, including a tubular body 86 having an inner end 88 which extends through hole 46*c*, is removably affixed to elbow 80 using a minimal amount of adhesive 89, so as to be replaceable if needed. As may be seen from FIG. 10, if it is desired to remove receptacle 84, sufficient force need only be applied to pull receptacle 84 out of engagement with ninety-degree elbow 80 in the direction of arrow A. A new receptacle may then be reinserted into hole 46*c* and bonded to elbow 80 with a new minimal amount of adhesive 89. An outer end 92 of tubular body 86 includes a vacuum opening 92 that is covered by a pivoting valve member 94 to prevent the induction of air there through. This maintains a vacuum within the central vacuum system 10. Vacuum opening 92 is therefore operatively connected to dirt collection chamber 54 by way of a conduit which connects to receptacle 84 at one end and extends through wall 56 and into dirt collection chamber 54*b*. The conduit is disclosed in the attached figures as the rigid ninety-degree elbow 80, forty-five degree elbow 82 and straight tube 78. Vacuum opening 92 may however be operatively connected to dirt collection chamber 54*b* by a flexible hose or any other suitable mechanism without departing from the scope of the present invention.

A sheathed electrical cable 96 includes an outer sheath 98 in which a pair of electrical conductors (not shown) is disposed, one end of cable 96 being connected to an electrical switch 100 of receptacle 84 and an opposite end being connected to a main control circuit board 102 (FIGS. 4 and 5) that controls the operation of vacuum canister 16. Sheathed cable 96 snap-fits to wall 56 by way of a plurality of resilient snap clips 104. When valve member 94 is pivoted to the open position so that a hose-end fitting 106 of a portable vacuum hose 91 may be connected to vacuum opening 92, switch 100 allows electrical current to flow through electrical cable 96 thereby starting motor 64 and hence vacuum pump 66. When hose-end fitting 106 is removed from vacuum opening 92 and valve member 94 is pivoted to the closed position, electrical switch 100 stops electrical current from flowing through electrical cable 96, thereby stopping motor 64 and turning off vacuum pump assembly 58. Valve member 94 is spring-biased to the closed position so as to prevent the induction of air into vacuum opening 92 when receptacle 84 is not in use.

The vacuum canister 16 having auxiliary vacuum intake assembly 30 functions in the following manner:

Valve member 94 is pivoted into the open position. This activates switch 100 thereby starting motor 64 and vacuum pump 66. Hose-end fitting 106 of a portable hose 91 is inserted into vacuum opening 92. Air is sucked through the portable hose into vacuum opening 92, down ninety-degree elbow 82, through forty-five degree elbow 80, down short straight tube 78 in hole 46*c* and into dirt collection chamber 54*b*. The air is sucked through filter 72, upwardly through bore 68 and into clean chamber 54*a*. The cleaned air is then exhausted into house 12 through exhaust pipe 50.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A vacuum canister for use in a central vacuum system, said vacuum canister comprising:

a housing having a dirt collection chamber and a clean chamber separated from the dirt collection chamber, whereby a hole extends through said housing into the clean chamber;

a wall extending intermediate the clean chamber and the dirt collection chamber of the housing, whereby said wall further defines an aperture that connects the dirt collection chamber to the clean chamber;

an auxiliary vacuum intake assembly disposed within the clean chamber, a first part of said intake assembly being mounted within the hole formed in the housing and a second part of said intake assembly being mounted within the aperture in the wall, the first and second parts being in communication with each other so that air may flow from the first part through the second part and into the dirt collection chamber;

a vacuum pump assembly housed within the clean chamber; and electrical wiring connecting the auxiliary vacuum intake assembly to the vacuum pump assembly.

2. The vacuum canister as disclosed in claim 1, wherein the electrical wiring is routed through the clean chamber of the canister.

3. The vacuum canister as disclosed in claim 1, wherein the electrical wiring is adapted to be separated from the flow of dirt-laden air.

4. The vacuum canister as disclosed in claim 3, wherein the electrical wiring is secured within the clean chamber to the wall using a plurality of resilient snap clips.

5. The vacuum canister as disclosed in claim 1, wherein the auxiliary vacuum intake assembly includes a selectively coverable receptacle, and the electrical wiring includes an electrical switch mounted on the receptacle, the switch being operable between an on position when a portable hose may be inserted into said intake assembly and an off position when the portable hose may be removed from the intake assembly.

6. The vacuum canister as disclosed in claim 5, further comprising a valve member for selectively covering the receptacle, and wherein the valve member is pivotally movable from the closed position to the open position.

7. The vacuum canister as disclosed in claim 6, wherein the valve member is spring-biased to the closed position.

8. The vacuum canister as disclosed in claim 6, wherein the switch is responsive to the movement of the valve member, said switch actuating the vacuum pump assembly when the valve member is moved to the open position.

9. The vacuum canister as disclosed in claim 6, wherein the receptacle is adapted to receive a hose-end fitting of a portable vacuum hose when the valve member is moved to the open position.

10. The vacuum canister as disclosed in claim 5, further comprising:

a conduit connected to the receptacle at one end and extending through the aperture in said wall and into the dirt collection chamber.

11. The vacuum canister as disclosed in claim 10, wherein the conduit is substantially rigid.

12. The vacuum canister as disclosed in claim 11, wherein the receptacle is removably connected to the conduit using an adhesive applied in such a manner so as to be breakable upon application of sufficient external force.

13. The vacuum canister as disclosed in claim 5, wherein the auxiliary vacuum intake assembly includes a straight tube which extends through the aperture formed in the wall in sealing engagement therewith, and first and second elbows affixed to opposing ends thereof.

14. The vacuum canister as disclosed in claim 13, wherein the straight tube is integrally molded with said wall.

15. The vacuum canister as disclosed in claim 14, wherein the inner end of the tubular body is removably connected to the first elbow using an adhesive in such a manner as to be breakable upon application of sufficient external force.

16. The vacuum canister as disclosed in claim 13, wherein the receptacle includes a tubular body having an inner end that extends through the hole of the housing and is connected to the first elbow.

17. A vacuum canister for use in a central vacuum system, the system having at least one receptacle adapted to receive a portable vacuum hose, the receptacle being connected to the canister by at least one conduit, the canister having an exhaust pipe exiting therefrom for exhausting cleaned air from the system; said vacuum canister comprising:

a housing having an upper end and a lower end, the upper end defining a first opening and the lower end defining a second opening, the housing further defining at least one hole therein, the hole being proximate the upper end of the housing;

a cover disposed over the first opening;

a dust collection bin disposed under the second opening;

a wall disposed between the upper and lower ends of said housing, said wall having an upper surface proximate the upper end of said housing and a lower surface proximate the lower end of said housing, whereby a clean chamber is formed between said upper surface and said upper end, and a dirt collection chamber is formed between said lower surface and said lower end; wherein said wall further defines a bore and an aperture that each connect the clean chamber to the dirt collection chamber;

a vacuum pump assembly including a motor for generating a vacuum in the system, the vacuum pump assembly being disposed within the clean chamber and proximate the bore in the wall, whereby said pump assembly causes air to be suctioned from the dirt collection chamber to the clean chamber through the bore;

a filter support extending from the lower surface of the wall and into the dirt collection chamber, said filter support being proximate the bore so that air is suctioned through the filter as it moves toward the bore;

an auxiliary vacuum intake assembly disposed within the clean chamber, a first part of said intake assembly being mounted within the second hole in the housing and a second part of said intake assembly being mounted within the aperture in the wall, the first and second parts being in communication with each other so that air may flow from the first part, through the second part and into the second chamber.

18. A vacuum canister for use in a central vacuum system, the system having at least one receptacle adapted to receive a portable vacuum hose, the receptacle being connected to the canister by at least one conduit, the canister having an exhaust pipe exiting therefrom for exhausting cleaned air from the system; said vacuum canister comprising:

a housing having a wall with an upper end and a lower end, the upper end defining a first opening and the lower end defining a second opening, the wall defining at least one hole therein, the hole being proximate the upper end of the wall;

a cover disposed over the first opening;

a dust collection bin disposed under the second opening;

a wall disposed between the upper and lower ends of said housing, said wall having an upper surface proximate the upper end and a lower surface proximate the lower end, whereby a clean chamber is formed between said upper surface and said upper end, and a dirt collection chamber is formed between said lower surface and said lower end; wherein said wall further defines a bore and an aperture that each connect the clean chamber to the dirt collection chamber;

a vacuum pump assembly including a motor for generating a vacuum in the system, the vacuum pump assembly being disposed within the clean chamber and proximate the bore in the wall, whereby said pump assembly causes air to be suctioned from the dirt collection chamber to the clean chamber through the bore;

a filter support extending from the lower surface of the wall and into the dirt collection chamber, said filter support being proximate the bore so that air is suctioned through the filter as it moves toward the bore;

an auxiliary vacuum intake assembly disposed within the clean chamber, a first part of said intake assembly being mounted within the second hole in the housing and a second part of said intake assembly being mounted within the aperture in the wall, the first and second parts being in communication with each other so that air may flow from the first part, through the second part and into the second chamber; and electrical wiring connecting the auxiliary vacuum intake assembly to the vacuum pump assembly.

19. The vacuum canister as disclosed in claim 18, wherein the auxiliary vacuum intake assembly includes a selectively coverable receptacle, and the electrical wiring includes an electrical switch mounted on the receptacle, the switch being operable between an on position when a portable hose is inserted into said intake assembly and an off position when the portable hose is removed from said intake assembly.

20. The vacuum canister as disclosed in claim 18, wherein the electrical wiring is routed through the clean chamber of the canister.

21. The vacuum canister as disclosed in claim 18, wherein the electrical wiring is adapted to be separated from the flow of dirt-laden air.

* * * * *